US005494099A

United States Patent [19]

Chiba et al.

[11] Patent Number: 5,494,099

[45] Date of Patent: Feb. 27, 1996

[54] HEAT EXCHANGER

[75] Inventors: Tomohiro Chiba; Kenichi Sasaki, both of Isesaki, Japan

[73] Assignee: Sanden Corporation, Isesaki, Japan

[21] Appl. No.: 440,248

[22] Filed: May 12, 1995

[30] Foreign Application Priority Data

May 16, 1994 [JP] Japan ..... 6-124689

[51] Int. Cl.[6] ..... F28D 1/03; F28F 1/22

[52] U.S. Cl. ..... 165/148; 165/171

[58] Field of Search ..... 165/148, 171

[56] References Cited

U.S. PATENT DOCUMENTS

| | | | |
|---|---|---|---|
| 1,903,125 | 12/1930 | Modine . | |
| 2,734,259 | 9/1951 | Beck . | |
| 2,924,437 | 2/1960 | Wilkins | 165/170 X |
| 3,406,750 | 10/1968 | Pauls | 165/148 |
| 5,411,079 | 5/1995 | Sasaki . | |

FOREIGN PATENT DOCUMENTS

| | | | |
|---|---|---|---|
| 685517 | 8/1951 | United Kingdom . | |
| 1432134 | 4/1976 | United Kingdom | 165/171 |

*Primary Examiner*—Allen J. Flanigan
*Attorney, Agent, or Firm*—Baker & Botts

[57] ABSTRACT

A heat exchanger, such as an evaporator, includes an upper tank and a lower tank and a plurality of heat exchange units extending between the upper and lower tanks. Each heat exchange unit includes a plurality of pipe members, each having a longitudinal central axis, which place the upper and lower tanks in fluid communication. The pipe members of each heat exchange unit are arranged such that their longitudinal central are aligned in a first plane. The heat exchange units are oriented such that the first plane is perpendicular to a flow direction of air which passes through the heat exchanger. Each heat exchange unit further comprises a plate member which extends along a second plane which is parallel to the first plane. The plate members are provided with a plurality of rows of louvers and a plurality of plane regions. The pipe members are connected to the corresponding plane regions of the plate member. The second plane is offset from the first plane toward the downstream side with respect to the flow of air passing through the heat exchanger.

19 Claims, 16 Drawing Sheets

HEAT EXCHANGER

BACKGROUND OF THE INVENTION

1. Field of the Invention

The present invention generally relates to a heat exchanger, such as a condenser or an evaporator, and more particularly, to heat exchangers including at least one tank unit through which the heat medium is conducted through a plurality of pipe members.

2. Description of the Prior Art

A heat exchanger, such as an evaporator for use in an automotive air conditioning systems, as illustrating in FIG. 1, is well known in the art. For example, such heat exchangers are described in U.S. patent application Ser. No. 08/352,808, which is hereby incorporated by reference.

Referring to FIG. 1, an evaporator 100 includes an upper tank 110 and a lower tank 120 which is vertically spaced from upper tank 110. Upper and lower tanks 110 and 120 may be made of an aluminum alloy and are rectangular parallelepiped in shape. Evaporator 100 further includes a plurality of heat exchange units 130 at which an exchange of heat occurs. Each of heat exchange units 130 also may be made of an aluminum alloy and includes a plurality identical circular pipe portions 131 which are spaced from one another at about equal intervals and a plurality of plane portions 132 which extend between adjacent pipe portions 131. In each heat exchange unit 130, pipe portions 131 and plane portions 132 are arranged such that the longitudinal central axes of pipe portions 131 are located in the same plane as plane portions 132.

Heat exchange units 130 may be arranged in parallel in a direction of length of evaporator 100, indicated by axis $Y_1$-$Y_2$ of the three-dimensional coordinates shown in FIG. 1, at substantially equal intervals, and may extend between upper and lower tanks 110 and 120. Upper and lower tanks 110 and 120 are placed in fluid communication through pipe portions 131 of heat exchange units 130. As illustrated in FIG. 2, pipe portions 131 of adjacent heat exchange units 130 are offset by one half of the length of the interval between adjacent pipe portions 131. Furthermore, directions of width and height of evaporator 100 are indicated by axis $X_1$-$X_2$ and axis $Z_1$-$Z_2$ of the three-dimensional coordinates shown in FIG. 1, respectively. Moreover, axes $X_1$-$X_2$ and $Y_1$-$Y_2$ in FIG. 2, axes $Y_1$-$Y_2$ and $Z_1$-$Z_2$ in FIG. 4, and axes $X_1$-$X_2$ and $Z_1$-$Z_2$ in FIG. 5 correspond to the axes of the three-dimensional coordinates shown in FIG. 1.

Referring to FIGS. 3–5, evaporator 100 is provided with a plurality of louvers 133 formed in plane portions 132. Each louver 133 is parallel to a plane which is perpendicular to the longitudinal central axes of pipe portions 131. As a result of forming louvers 133, generally hexagonal openings 135 are formed in plane portions 132 at the positions which are located between the adjacent louvers 133. Although only some of the louvers 133 are illustrated in FIG. 1, louvers 133 are formed in each plane portion 132 and are arranged from the upper to lower ends of each plane portion 132.

Referring to FIG. 1 again, an interior space of the upper tank 110 is divided by partition plate 140 into a first chamber section 111 and a second chamber section 112. Upper tank 110 is provided with an inlet pipe 150 fixedly connected through an outside end surface of first chamber section 111 and an outlet pipe 160 fixedly connected through an outside end surface of second chamber section 112. Furthermore, when evaporator 100 is installed, heat exchange units 130 are oriented so that plane portions 132 are aligned perpendicular to the flow direction of air "A" which passes through evaporator 100. Consequently, pipe portions 131 also are perpendicular to the flow direction of the air passing through evaporator 100. The flow direction of the air passing through evaporator 100 also is indicated by arrow "A" in FIGS. 2, 3, and 5.

During operation of the automotive air conditioning system, the refrigerant fluid is conducted into first chamber section 111 of upper tank 110 from an element of the automotive air conditioning system, such as a condenser (not shown), via inlet pipe 150. The refrigerant fluid in first chamber section 111 flows downwardly through a first group of pipe portions 131 of heat exchange units 130. In doing so, the refrigerant fluid absorbs heat from the air flowing across the exterior surfaces of heat exchange units 130 through plane portions 132 and pipe portions 131.

The refrigerant fluid then flows into a first portion of an interior space of lower tank 120, which corresponds to first chamber section 111. Thereafter, the refrigerant fluid flows to a second portion of the interior space of lower tank 120, which corresponds to second chamber section 112, and then flows upwardly through a second group of pipe portions 131 of heat exchange units 130. In doing so, the refrigerant fluid further absorbs heat from the air flowing across the exterior surfaces of heat exchange units 130 through plane portions 132 and pipe portions 131.

Then, the refrigerant fluid flows into second chamber section 112 of upper tank 110. The refrigerant fluid in second chamber section 112 then is conducted to other elements of the automotive air conditioning system, such as a compressor (not shown), via outlet pipe 160.

Referring to FIGS. 1–3, the heat exchange operation in this prior art evaporator 100 is further described below. When the air passes through evaporator 100, two air flow paths, which are indicated by arrows "B" and "C" (FIG. 2), respectively, are generally generated. In the air flow path indicated by arrows "B", the air passes through openings 135 in a direction indicated by axis $X_1$-$X_2$ along louvers 133. On the other hand, in the air flow path indicated by arrows "C'", the air flows along an exterior surface of an upstream semicylindrical region of circular pipe portions 131 until it collides with the surface which is located at the boundary between pipe portions 131 and plane portions 132. Thereafter, the air flows into opening 135. In both air flow paths indicated by arrows "B" and "C'", the heat from the air is absorbed through plane portions 132 and/or pipe portions 131 and transferred to the refrigerant fluid.

Since the path of the air which passes through evaporator 100 is narrowed between the adjacent pipe portions 131, the speed of the air flow increases. As a result, the speed of the air flow is maximized at plane portions 131, of each heat exchange unit 130. Since the air collides with the surface between pipe portions 131 and plane portions 132 with the maximum flow speed, the flow resistance caused thereby becomes large. The flow resistance of the air passing through evaporator 100 sometimes increases to an extent that evaporator 100 performs inefficiently.

Furthermore, in the air flow path indicated by arrows "C'", the air flowing along the exterior surface of the upstream semicylindrical region of the circular pipe portions 131 changes its flow direction at the boundary between pipe portions 131 and plane portions 132. As a result, only a small portion of the air which has passed through the opening 135 flows along the exterior surface of the downstream semicylindrical region of circular pipe portions 131. Therefore, the heat exchange between the air and the downstream semicylindrical region of circular pipe portions 131 is insignificant, causing inefficient heat exchange at each heat exchange unit 130.

SUMMARY OF THE INVENTION

Accordingly, it is an object of the preferred embodiments to provide a heat exchanger in which the heat exchange is efficiently carried out.

It is another object of the preferred embodiments to provide a heat exchanger with a small flow resistance.

In order to obtain the above objects, a heat exchanger disclosed by the preferred embodiments includes a first tank and a second tank spaced vertically from the first tank, and a plurality of heat exchange units in which heat exchange occurs. Each of the heat exchange units comprises a plurality of pipe members, each having a longitudinal central axis, which place the first tank and the second tank in fluid communication.

The pipe members of each heat exchange unit are arranged such that their longitudinal central axes are aligned in a first plane. Each of heat exchange units is oriented such that the first plane is perpendicular to a flow direction of air which passes through the heat exchanger.

Each of the heat exchange units further comprises a plate member which extends along a second plane which is parallel to the first plane. A plurality of openings are formed in the plate member. The plate members are arranged in a plurality of rows which are parallel to the longitudinal central axes of the pipe members. A plurality of plane regions are defined between the adjacent rows of openings. A plurality of louvers are formed in the openings. The pipe members are connected to the corresponding plane regions of the plate member in each heat exchange unit.

The second plane is offset from the first plane toward the downstream side with respect to the flow of air passing through the heat exchanger.

DETAILED DESCRIPTION OF THE PREFERRED EMBODIMENTS

FIGS. 6–10 illustrate an evaporator in accordance with a first preferred embodiment. In FIGS. 6–10, the same numerals are used to denote elements which are identical to the similarly numbered elements shown in FIGS. 1–5, so a detailed explanation thereof is omitted. Furthermore, directions of width, length and height of evaporator 10 are indicated by axis $X_1$-$X_2$, axis $Y_1$-$Y_2$ and axis $Z_1$-$Z_2$ of three-dimensional coordinates shown in FIG. 6, respectively. Moreover, axes $X_1$-$X_2$ and $Y_1$-$Y_2$ in FIG. 7, axes $Y_1$-$Y_2$ and $Z_1$-$Z_2$ in FIG. 9, and axes $X_1$-$X_2$ and $Z_1$-$Z_2$ in FIG. 10 correspond to the axes of the three-dimensional coordinates shown in FIG. 6.

Figure 1:
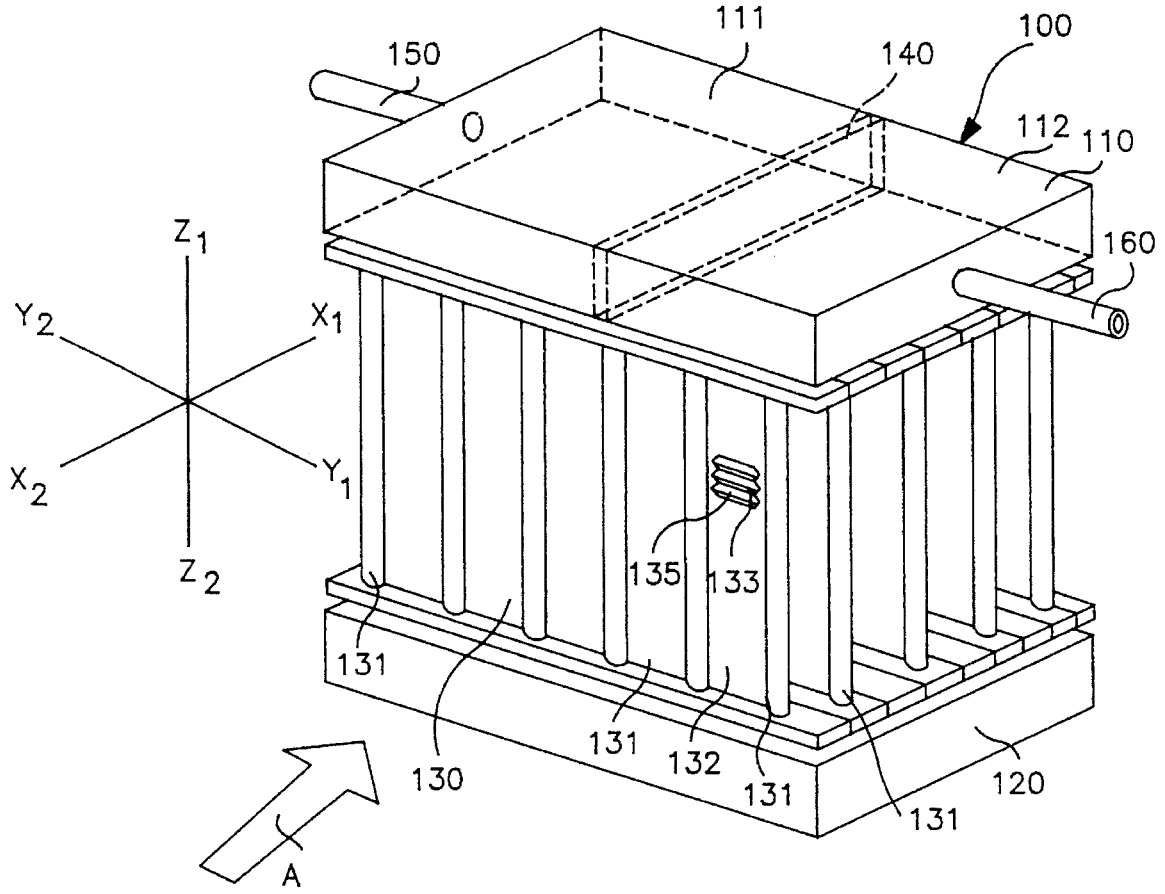
FIG. 1 (PRIOR ART)
FIG. 1 is a perspective view of an evaporator in accordance with the prior art.
Figure 2:
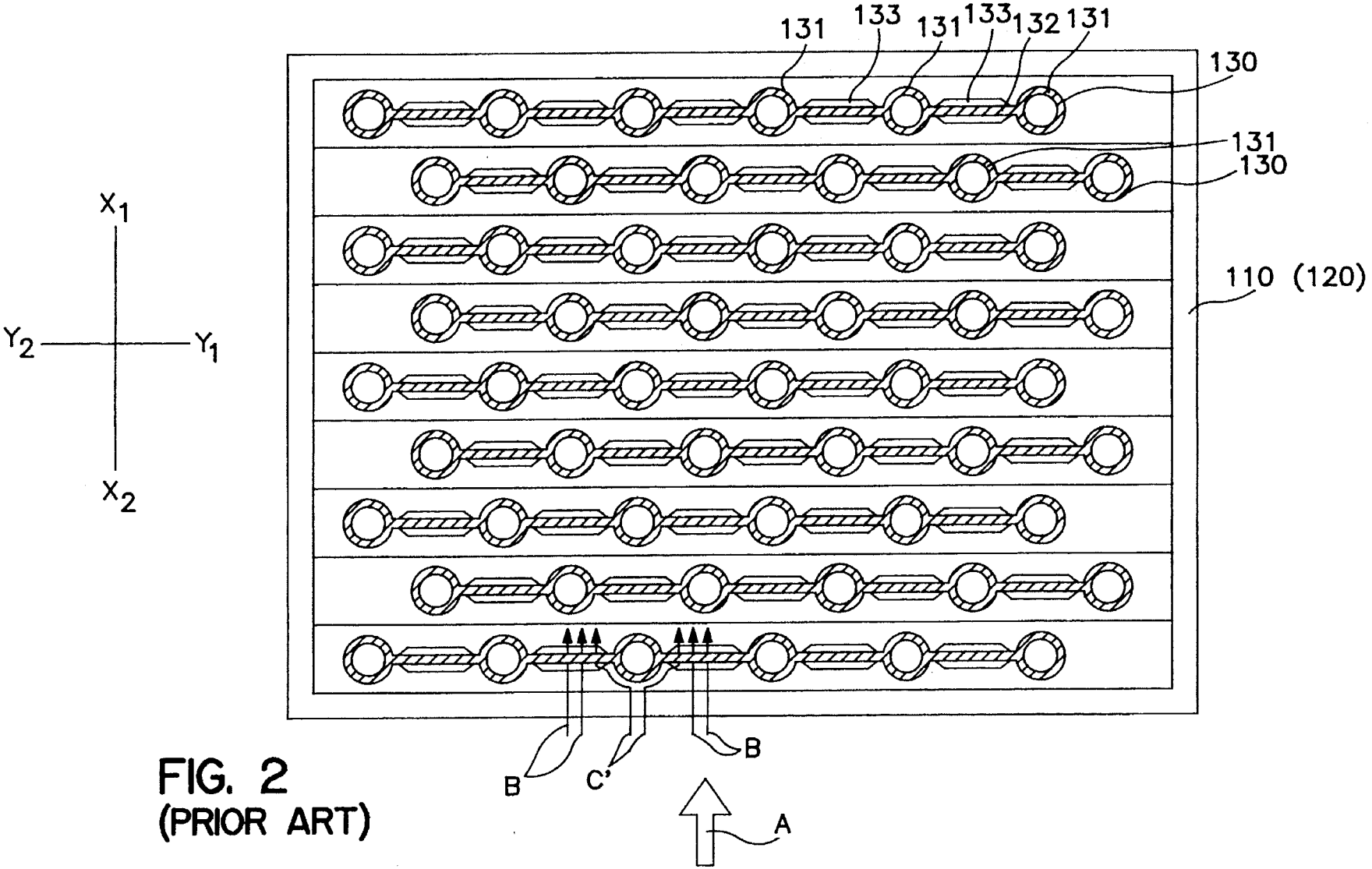
FIG. 2 (PRIOR ART)
FIG. 2 is a latitudinal cross-sectional view of the evaporator shown in FIG. 1.
Figure 3:
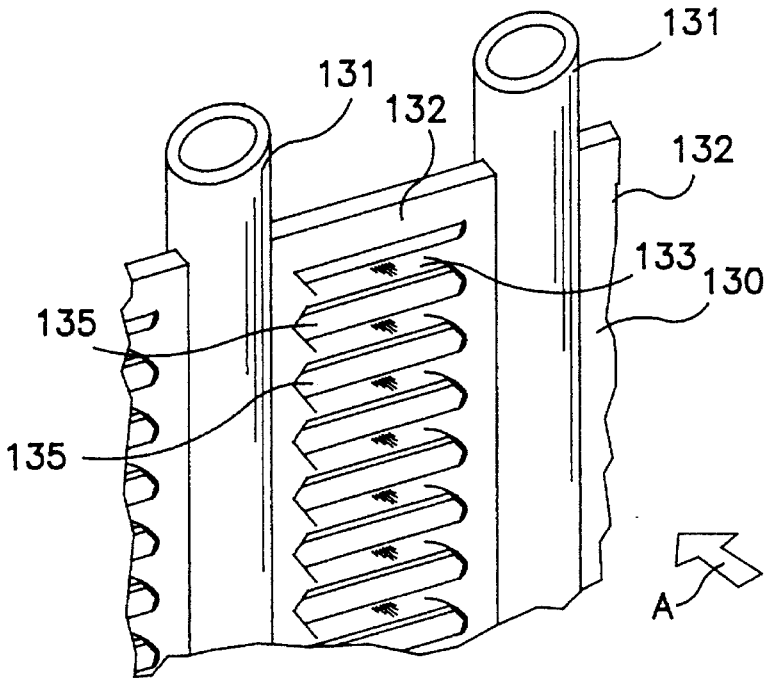
FIG. 3 (PRIOR ART)
FIG. 3 is an enlarged perspective view of a portion of the evaporator shown in FIG. 1.
Figure 4:
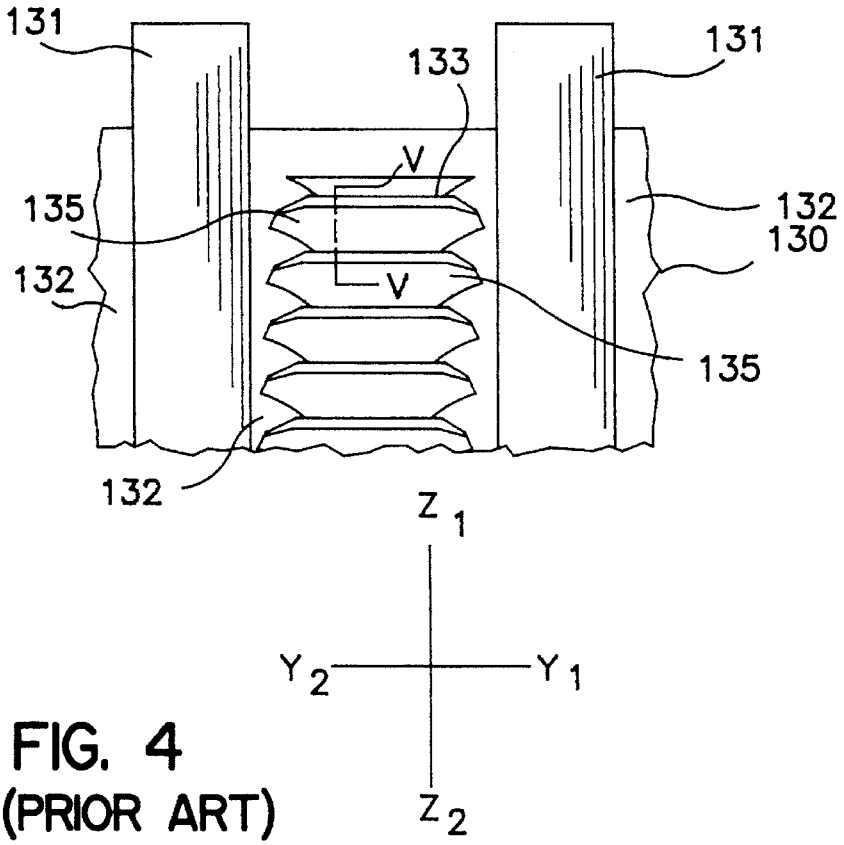
FIG. 4 (PRIOR ART)
FIG. 4 is an enlarged front view of a portion of the evaporator shown in FIG. 1.
Figure 5:
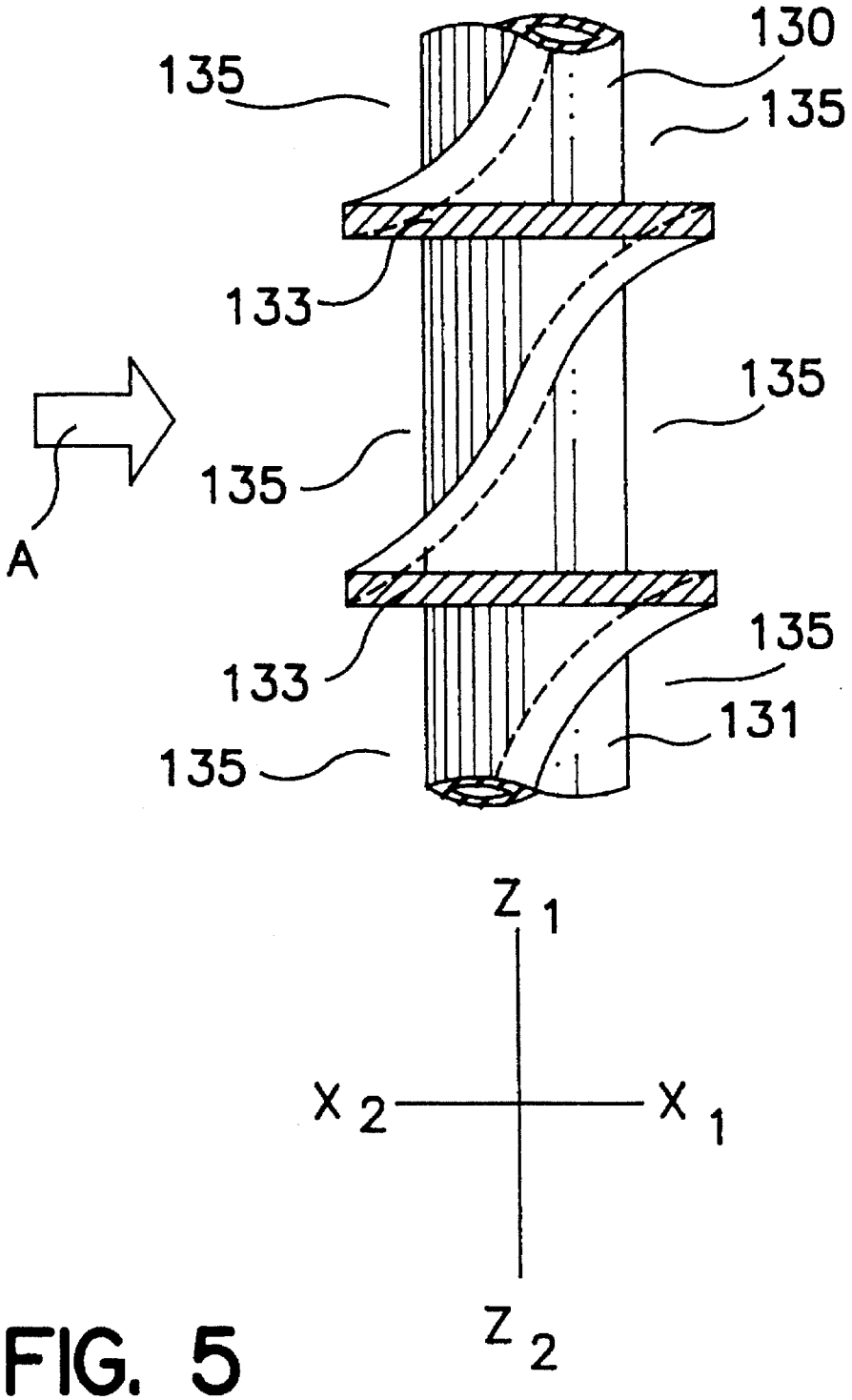
FIG. 5 (PRIOR ART)
FIG. 5 is an enlarged cross-sectional view taken along line V—V of FIG. 4.
Figure 6:
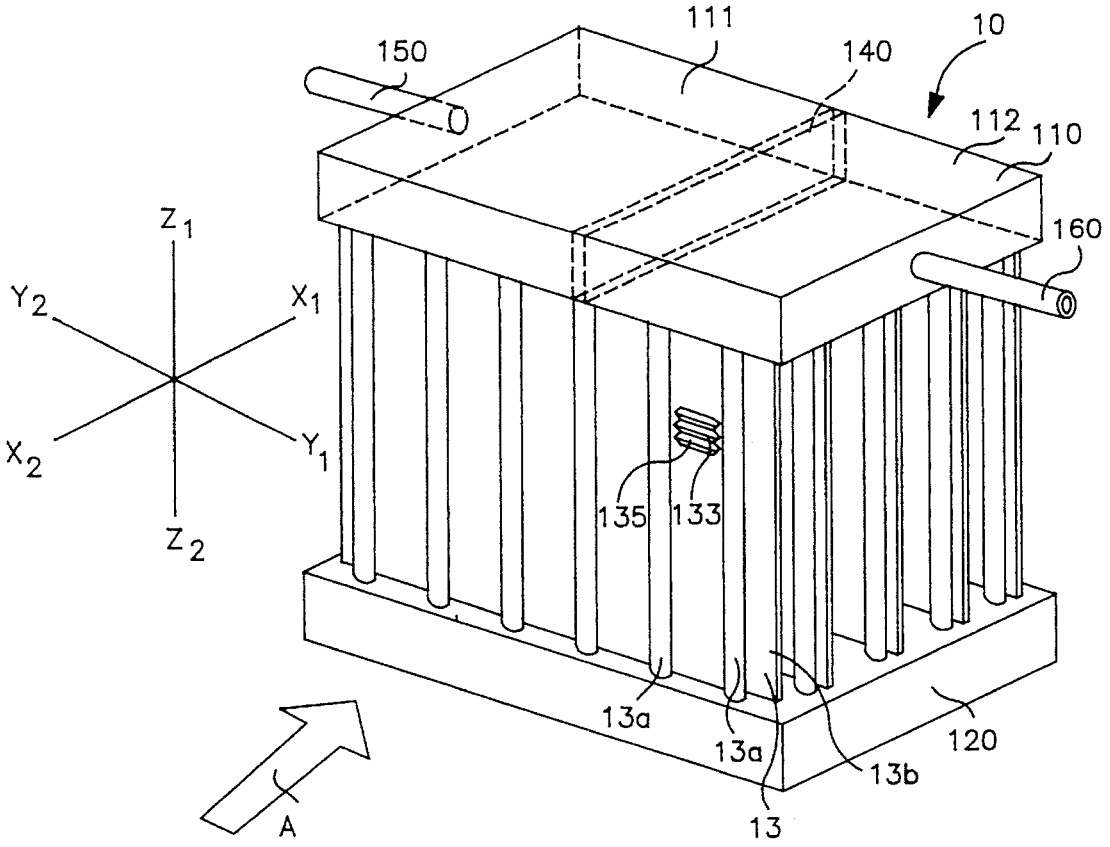
FIG. 6 is a perspective view of an evaporator in accordance with a first preferred embodiment.

Referring to FIG. 6, evaporator 10 includes an upper tank 110 and a lower tank 120 which is vertically spaced from upper tank 110. Evaporator 10 further includes a plurality of heat exchange units 13 at which an exchange of heat occurs. Each of heat exchange units 13 may be made of an aluminum alloy and includes a plurality of identical circular pipes **13*a* and rectangular plate 13*b* which is connected to circular pipes 13*a***.

Figure 7:
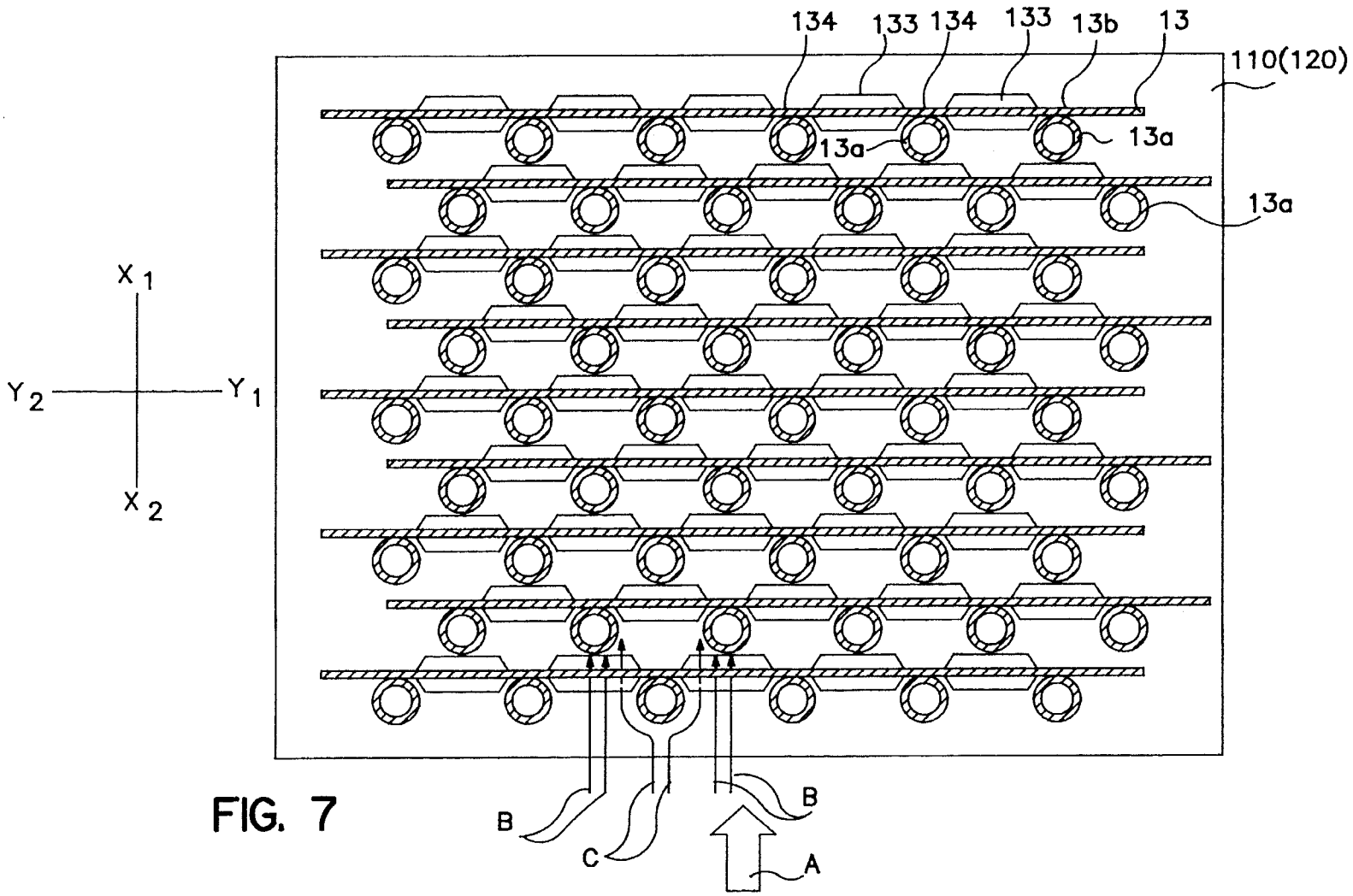
FIG. 7 is a latitudinal cross-sectional view of the evaporator shown in FIG. 6.
Figure 8:
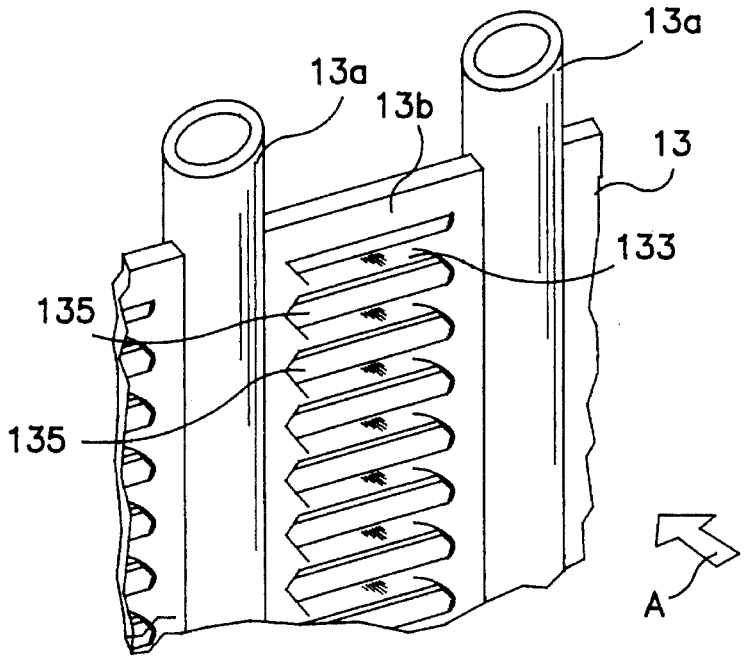
FIG. 8 is an enlarged perspective view of a portion of the evaporator shown in FIG. 6.
Figure 9:
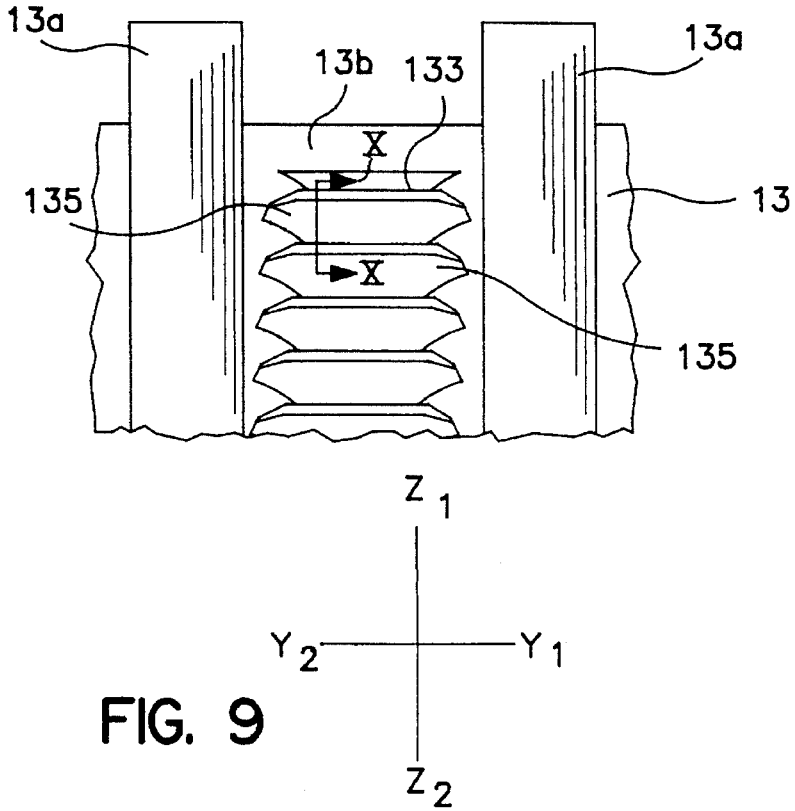
FIG. 9 is an enlarged front view of a portion of the evaporator shown in FIG. 6.
Figure 10:
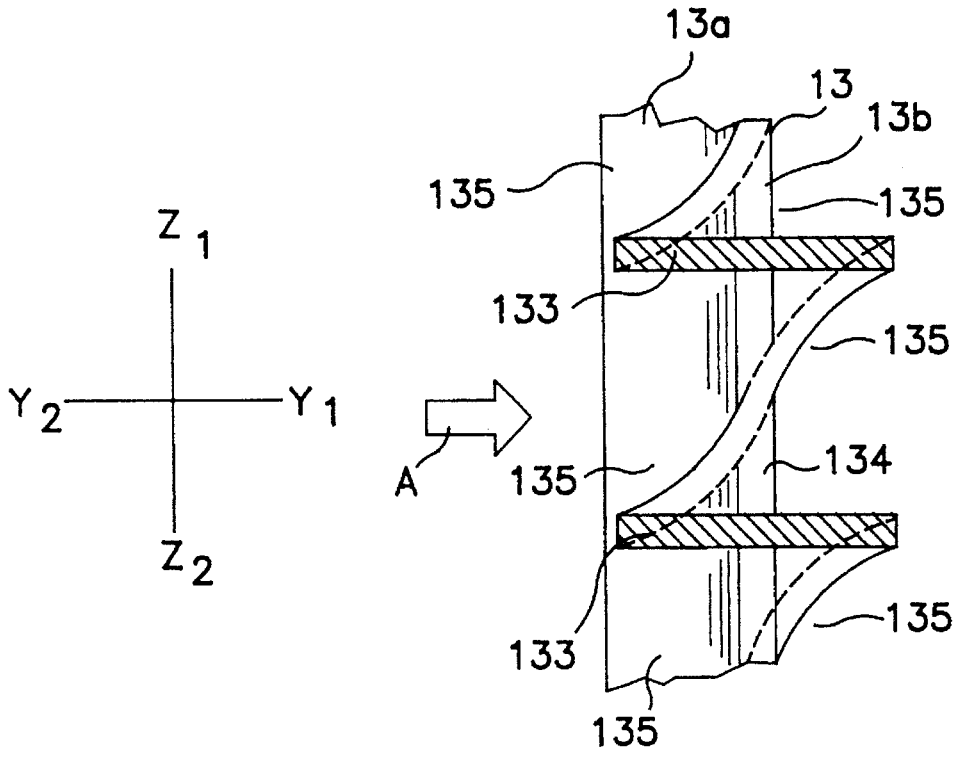
FIG. 10 is an enlarged cross-sectional view taken along line X—X of FIG. 9.

Referring to FIGS. 7–10, evaporator 10 is provided with a plurality of louvers 133 formed in plate **13*b* of each heat exchange unit 13. Generally hexagonal openings 135 are formed in plate 13*b* at positions which are located between the adjacent louvers 133. Although only some of louvers 133 are illustrated in FIG. 6, louvers 133 are aligned in a plurality of, for example, five rows which extend from the upper to lower ends of plate 13*b*. Rows of louvers 133 are spaced from one another in substantially equal intervals. A plurality of plane portions 134 are defined between the adjacent rows of louvers 133 in plate 13*b* as shown in FIG. 7. Plane portions 134** are spaced from one another in substantially equal intervals.

Referring to FIGS. 6 and 7, heat exchange units 13 may be arranged in parallel in substantially equal intervals, and extend between upper and lower tanks 110 and 120. Upper and lower tanks 110 and 120 are placed in fluid communication through pipes **13*a* of heat exchange unit 13. As illustrated in FIG. 7, circular pipes 13*a* of each heat exchange unit 13 are arranged such that their longitudinal central axes are located in a plane which is perpendicular to the flow direction "A" of the air passing through evaporator 10. Circular pipes 13*a* of each heat exchange unit 13 are spaced from one another at substantially equal intervals, and are connected to the corresponding plane portions 134 of rectangular plate 13*b*. In addition, circular pipes 13*a* of adjacent heat exchange units 13 are offset by one half of the length of the interval of pipes 13***a*.

As illustrated in FIGS. 6 and 7, heat exchange units 13 are oriented so that plates 13*b* are aligned perpendicular to the flow direction "A" of the air passing through evaporator 10. In this orientation of heat exchange units 13, the longitudinal central axes of circular pipes 13*a* are located along a first plane and rectangular plate 13*b* is located along a second plane which is parallel to the first plane. The second plane is offset from the first plane toward a downstream side with respect to the flow of air which passes through the evaporator 10. Plane regions 134 of rectangular plate 13*b* are connected to one peripheral portion of the corresponding circular pipes 13*a* farthest from the first plane.

Referring to FIGS. 11–16, evaporator 10 may be temporarily assembled by the following steps. For convenience in illustration, only some of louvers 133 are illustrated in FIGS. 13–16. Furthermore, the axes of the three-dimensional coordinates shown in FIGS. 11–16 correspond to those shown in FIG. 6.

Figure 11:
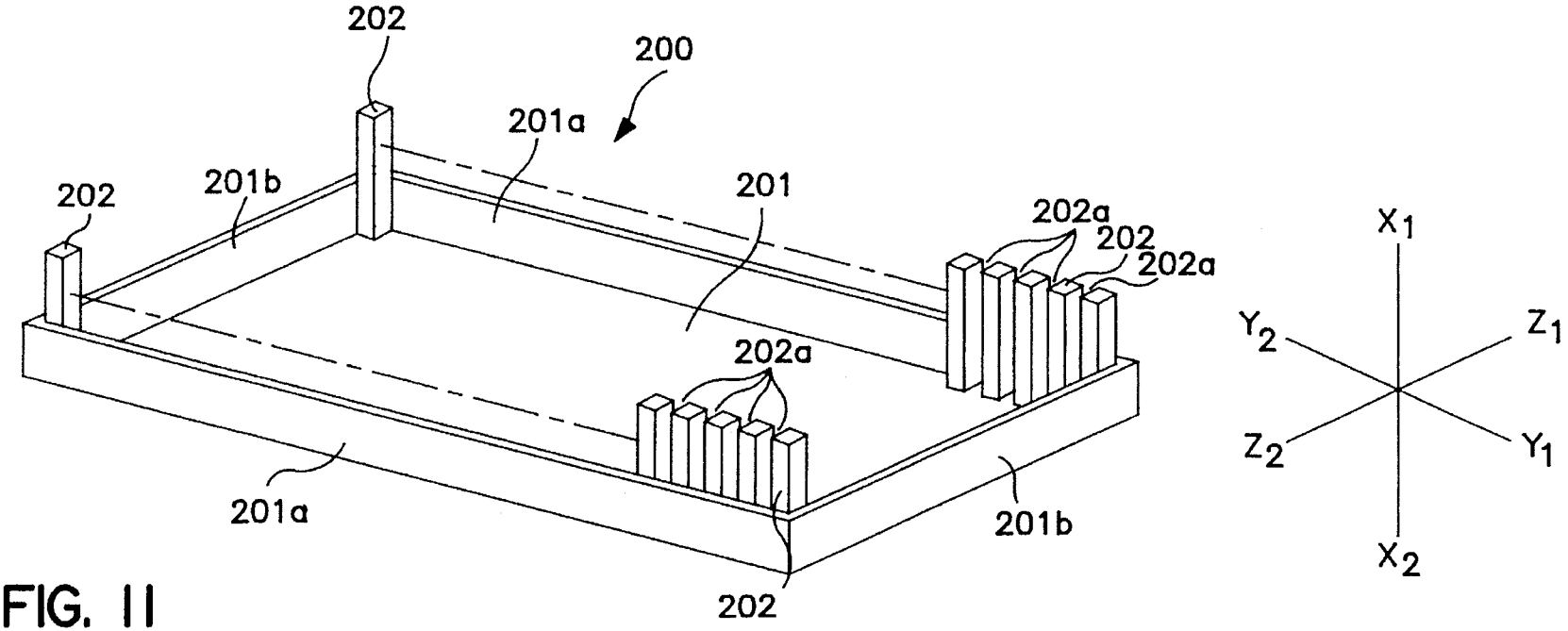
FIG. 11–16 are views illustrating an assembling process of the evaporator shown in FIG. 6.

In the first step, an assembling jig 200 as illustrated in FIG. 11 is prepared. Jig 200 includes rectangular block member 201 having a pair of rectangular plates 201*a* which upwardly project from longer sides of block member 201 and a pair of rectangular plates 201*b* which upwardly project from shorter sides of block member 201. Jig 200 further includes a plurality of square pillars 202 which upwardly project from block member 201. Square pillars 202 are arranged such that they are aligned along an inner side of the pair of plates 201*a*, respectively. Pillars 202 of the pair of rows are arranged to correspond to each other. Intervening space 202*a* is created between the adjacent pillars 202 of each row. Intervening space 202*a* is designed to be slightly greater than an outer diameter of circular pipes 13*a* of heat exchange unit 13. The distance between the pair of rows of pillars 202 is greater than the height of rectangular plate 13*b* of heat exchange unit 13. Furthermore, though only a few pillars 202 are illustrated in FIGS. 11–16, each of the rows is preferably formed by thirteen square pillars 202.

Figure 12:
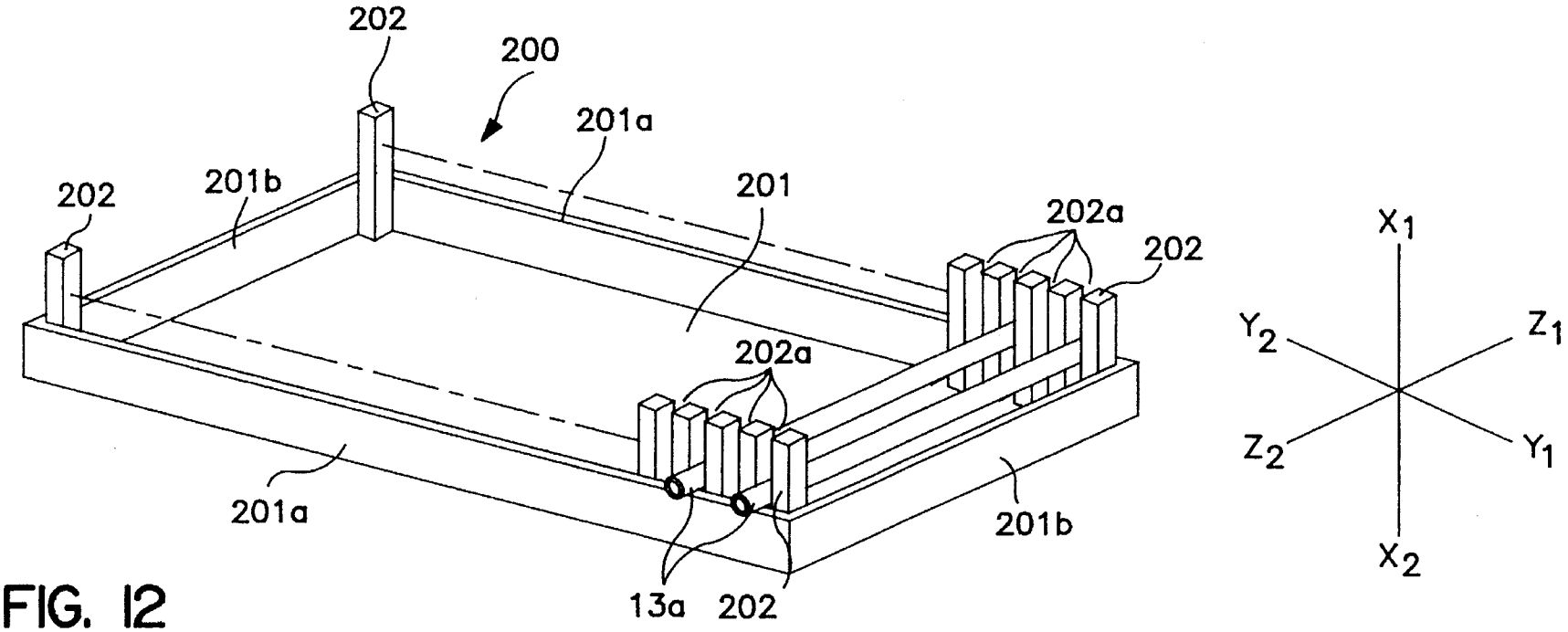

In the second step, as illustrated in FIG. 12, circular pipes 13*a* are disposed through the corresponding intervening spaces 202*a* and rest on plates 201*a* . Circular pipes 13*a* occupy alternative intervening spaces 202*a* so that the next assembled heat exchange unit has its circular pipes 13*a* aligned with intervening spaces 202*a* of adjacent heat exchange units.

Figure 13:
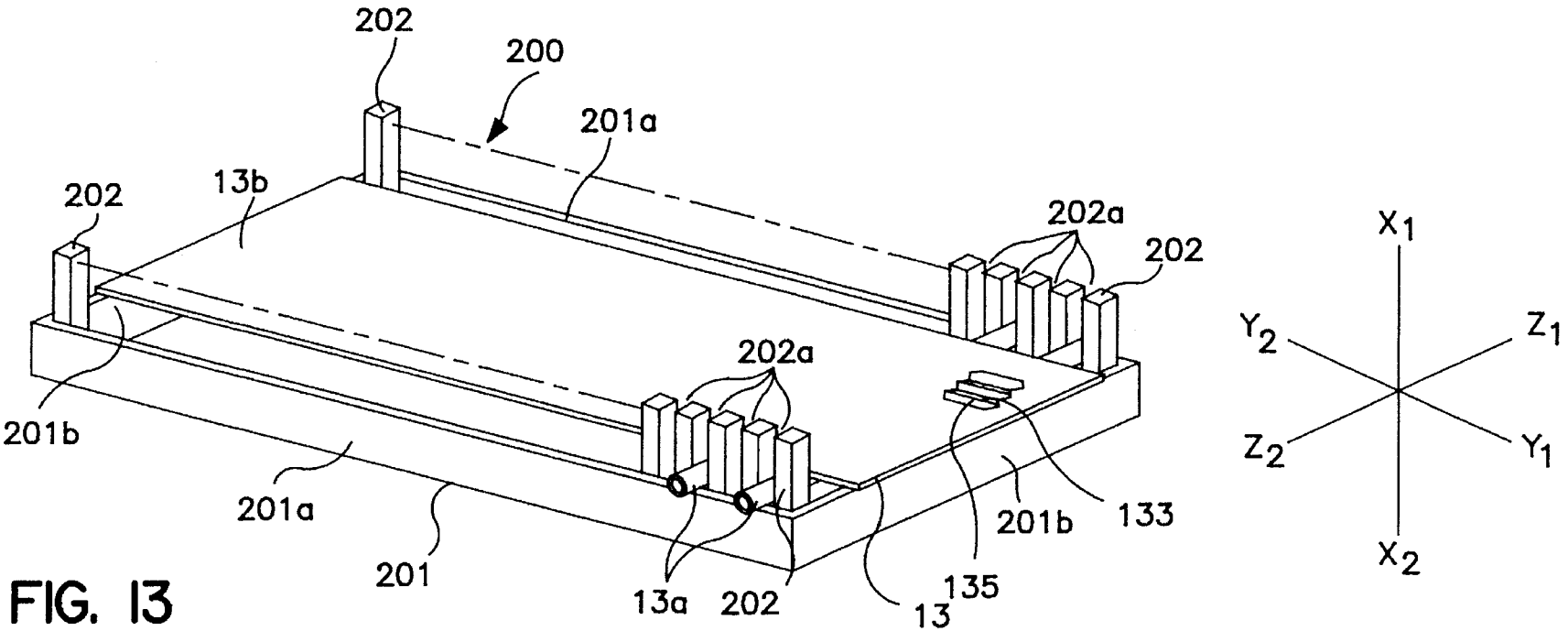

In the third step, as illustrated in FIG. 13, rectangular plate 13*b* is disposed on circular pipes 13*a* between the pair of rows of pillars 202. More specifically, circular pipes 13*a* and rectangular plate 13*b* are arranged such that plane portions 134 of plate 13*b* are in contact with corresponding circular pipes 13*a*. Therefore, each row of louvers 133 is positioned in the space between adjacent circular pipes 13*b*. Preferably, the center line of each row of louvers 133 may be aligned with the center line between adjacent circular pipes 13*b*. At this time, the first heat exchange unit 13 is temporarily assembled.

Figure 14:
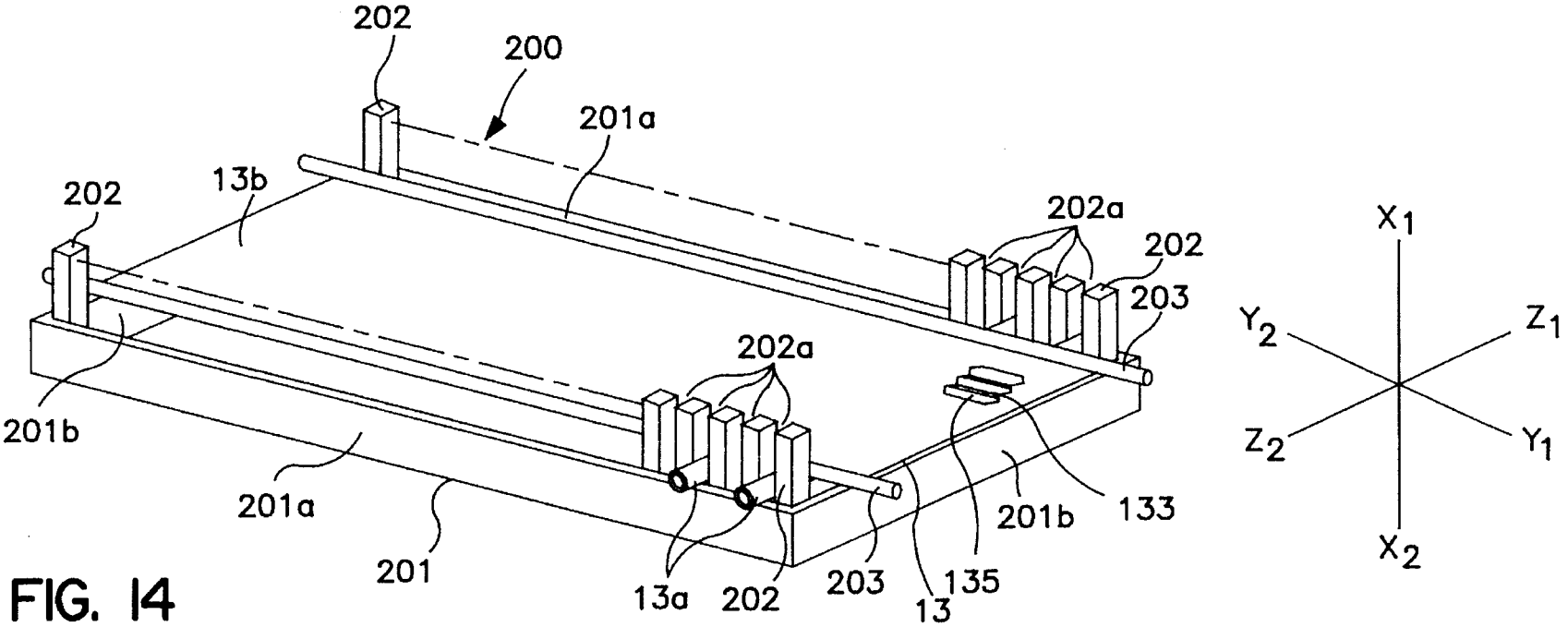

In the fourth step, as illustrated in FIG. 14, a pair of cylindrical rods 203 are disposed on circular pipes 13*a* between the row of pillars 202 and the edge of plate 13*b*. The diameter of cylindrical rods 203 determines the distance between the adjacent heat exchange units 13.

Figure 15:
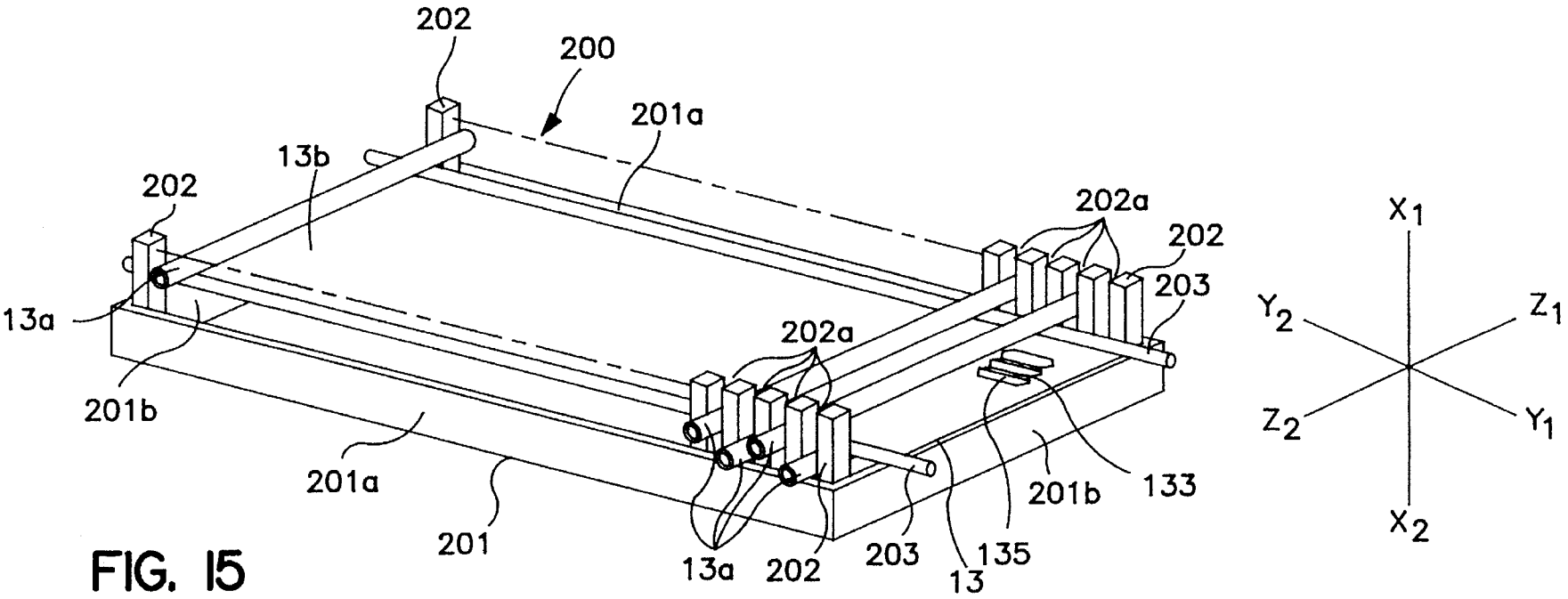

In the fifth step, as illustrated in FIG. 15, circular pipes 13*a* are disposed on the pair of cylindrical rods 203 through alternative intervening spaces 202*a* so that they are offset from circular pipes 13*a* of heat exchange unit 13 made in the second step.

Figure 16:
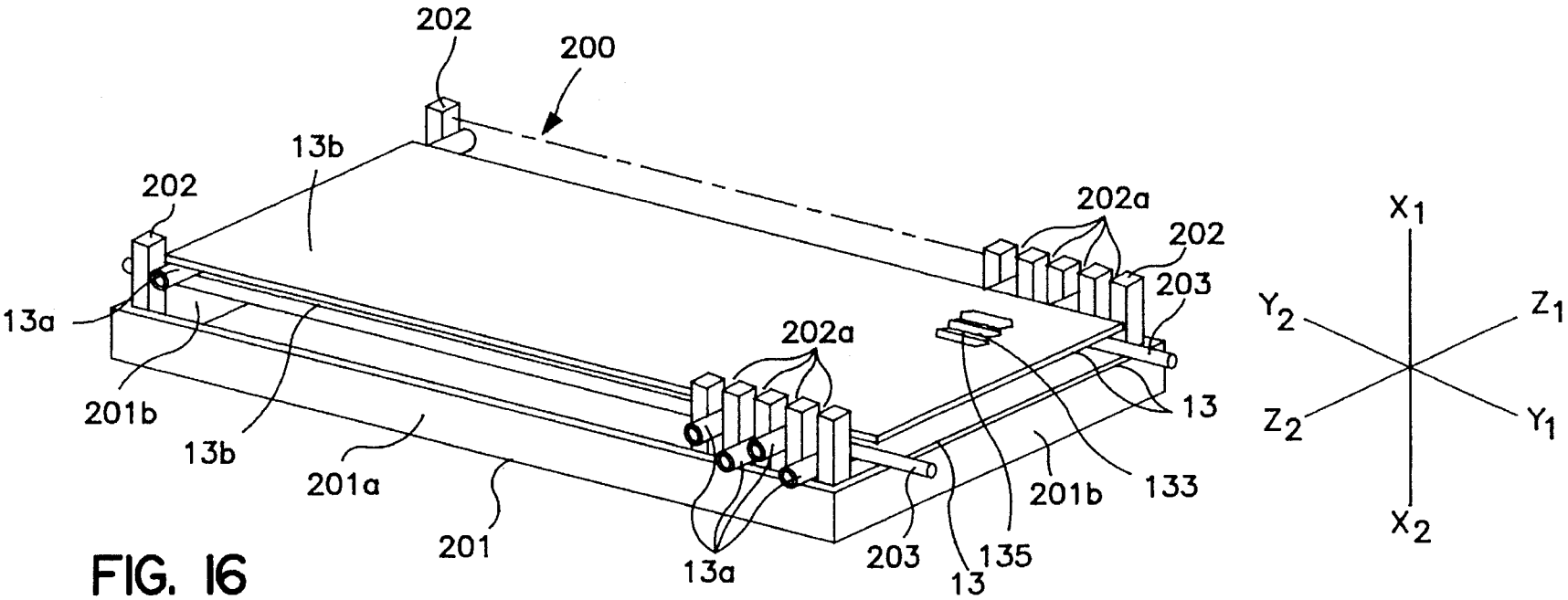

In the sixth step, as illustrated in FIG. 16, rectangular plate 13*b* is disposed on circular pipes 13*a* between the pair of rows of pillars 202. The arrangement of rectangular plate 13*b* and circular pipes 13*a* is similar to that in the third step, so an explanation thereof is omitted. At this time, the second heat exchange unit 13 is temporarily assembled on the first heat exchange unit 13.

By repeating the fourth through sixth steps, several layers of heat exchange units 13 are temporarily assembled with circular pipes 13*a* of adjacent heat exchange units 13 offset by one half of the length of the interval of circular pipes 13*a* . After a ninth heat exchange unit 13 is temporarily assembled, the sixth step proceeds to the seventh and final step of assembly. For convenience in illustration, the upper portion of each pillar 202 is omitted in FIGS. 11–16.

In the seventh and final step, the tip ends of circular pipes 13*a* are inserted into upper tank 110 a predetermined distance through corresponding circular holes (not shown) formed in the bottom surface of upper tank 110. Similarly, the other tip ends of circular pipes 13*a* are inserted into lower tank 120 a predetermined distance through corresponding circular holes (not shown) formed in the top end surface of lower tank 120. Then, the temporarily assembled evaporator 10 is temporarily clamped by a clamping jig (not shown), and then assembling jig 200 and cylindrical rods 203 are removed. Finally, the temporarily assembled evaporator 10 may be placed in a brazing furnace for a sequential brazing process.

With reference to FIG. 6, during operation of the automotive air conditioning system, the refrigerant fluid is conducted into first chamber section 111 of upper tank 110 from an element of the automotive air conditioning system, such as the condenser (not shown), via inlet pipe 150. The refrigerant fluid conducted into first chamber section 111 of upper tank 110 flows downwardly through a first group of pipe portions 13*a* of heat exchange units 13. When the refrigerant fluid flows downwardly through the first group of circular pipes 13*a* of heat exchange units 13, the refrigerant fluid absorbs heat from the air flowing across the exterior surfaces of heat exchange units 13.

The refrigerant fluid then flows into a first portion of an interior space of lower tank 120, which corresponds to first chamber section 111. Thereafter, the refrigerant fluid flows to a second portion of the interior space of lower tank 120, which corresponds to second chamber section 112. Then, the refrigerant flows upwardly through a second group of circular pipes 13*a* of heat exchange units 13. When the refrigerant fluid flows upwardly through the second group of circular pipes 13*a*, the refrigerant fluid further absorbs heat from the air flowing across the exterior surfaces of heat exchange units 13.

The refrigerant fluid then flows into second chamber section 112 of upper tank 110. Finally, the refrigerant fluid is conducted to other elements of the automotive air conditioning system, such as a compressor (not shown), via outlet pipe 160.

Referring to FIGS. 6 and 7 again, a heat exchange operation in evaporator 10 is further described below. When the air passes through evaporator 10, two air flow paths, indicated by arrows "B" and "C", are generally formed. The air in flow path "B" passes through the opening 135 in a direction indicated by axis $X_1$-$X_2$ along louvers 133. On the other hand, the air in flow path "C" first flows along the exterior surface of the upstream semi-cylindrical region of circular pipes 13*a*, and then gradually flows away from the exterior surface of the downstream semi-cylindrical region of circular pipes 13*a*. Thereafter, the air in path "C" flows into opening 135. In both air flow paths indicated by arrows "B" and "C", heat is absorbed into the refrigerant fluid in the circular pipes 13*a* through rectangular plate 13*b* and/or circular pipes 13*a*.

Since the flow path of the air is narrowed between the adjacent circular pipes 13*a* of each heat exchange unit 13, the speed of the air flow increases. However, since the distance between the adjacent circular pipes 13*a* measured along the rectangular plate 13*b* is maximized, the speed of the air flow is reduced in the space between adjacent circular pipes 13*a*. Since the air impinges upon the surface which is located at the boundary between circular pipes 13*a* and rectangular plate 13*b* with a lower flow speed, the flow resistance is relatively small. Accordingly, the flow rate of the air passing through the evaporator 10 is maintained at such a value so as to enhance the efficiency of the heat exchanger.

Advantageously, the air flowing along the exterior surface of the upstream semi-cylindrical region of circular pipes 13*a* gradually flows away from the exterior surface of the downstream semi-cylindrical region of circular pipes 13*a*. Thus, the air remains in contact with more of the periphery of the circular pipes than in the prior art. Therefore, the heat exchange between the air and the refrigerant fluid through circular pipes 13*a* is more efficiently carried out. Moreover, since rectangular plates 13*b* and circular pipes 13*a* are separately prepared in the manufacturing process of evaporator 10, louvers 133 can be formed in the rectangular plate 13*b* by a simple manufacturing process. Still further, since circular pipes 13*a* and rectangular plate 13*b* in each heat exchange unit 13 are arranged such that plane regions 134 of rectangular plate 13*b* are connected to the peripheral portion of circular pipes 13*a* farthest from the plane of the longitudinal central axes of circular pipes 13*a*, the length of louvers 133 can be increased. As a result, the heat exchange area and efficiency of evaporator 10 is increased.

FIGS. 17–21 illustrate portions of evaporators in accordance with second through sixth preferred embodiments, respectively. In FIGS. 17–21, the same numerals are used to denote similar elements as those shown in FIGS. 6–10, so a detailed explanation thereof is omitted. Furthermore, only features and effects derived from the respective second through sixth preferred embodiments will be described so that an explanation of the other features and effects similar to those of the first embodiment will be omitted. Moreover, axes $X_1$-$X_2$ and $Y_1$-$Y_2$ in FIGS. 17–21 correspond to the axes of the three-dimensional coordinates shown in FIG. 6.

Figure 17:
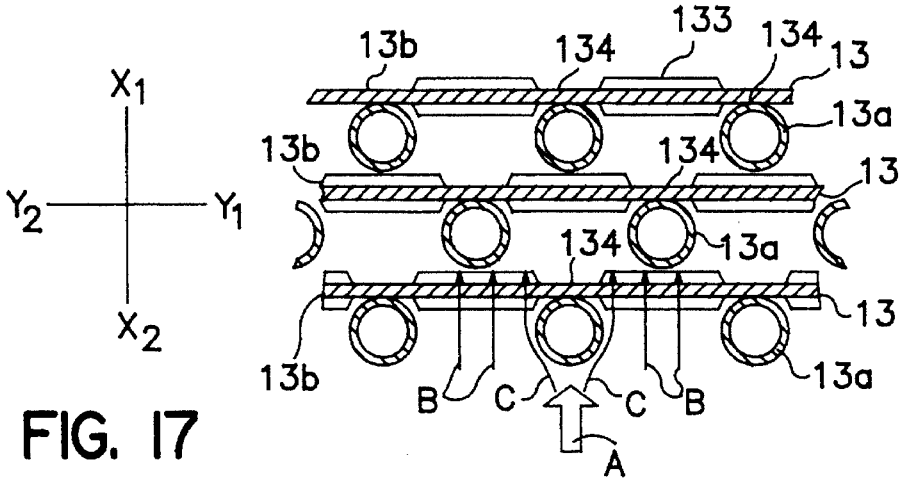
FIG. 17 is an enlarged latitudinal cross-sectional view of a portion of an evaporator in accordance with a second preferred embodiment.

In the second preferred embodiment, the evaporator may be temporarily assembled by a method similar to that in the first preferred embodiment, with the exception of having one difference: the fourth assembly step is omitted. As illustrated in FIG. 17, the adjacent heat exchange units 13 are in contact with each other at their circular pipes 13*a* and louvers 133. According to this embodiment, the width of the evaporator can be reduced in comparison with the first preferred embodiment so that an evaporator sized for smaller engine compartments is obtained.

Figure 18:
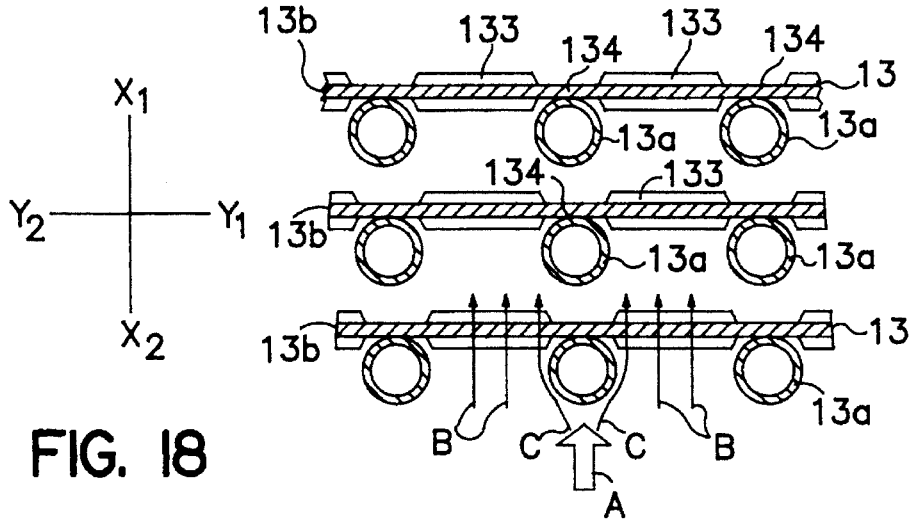
FIG. 18 is an enlarged latitudinal cross-sectional view of a portion of an evaporator in accordance with a third preferred embodiment.

In the third preferred embodiment, the evaporator may be temporarily assembled by a method similar to that in the first preferred embodiment, except that circular pipes 13*b* of adjacent heat exchange units 13 are aligned with each other. Accordingly, as illustrated in FIG. 18, circular pipes 13*b* are aligned along both the length and width of the evaporator.

Figure 19:
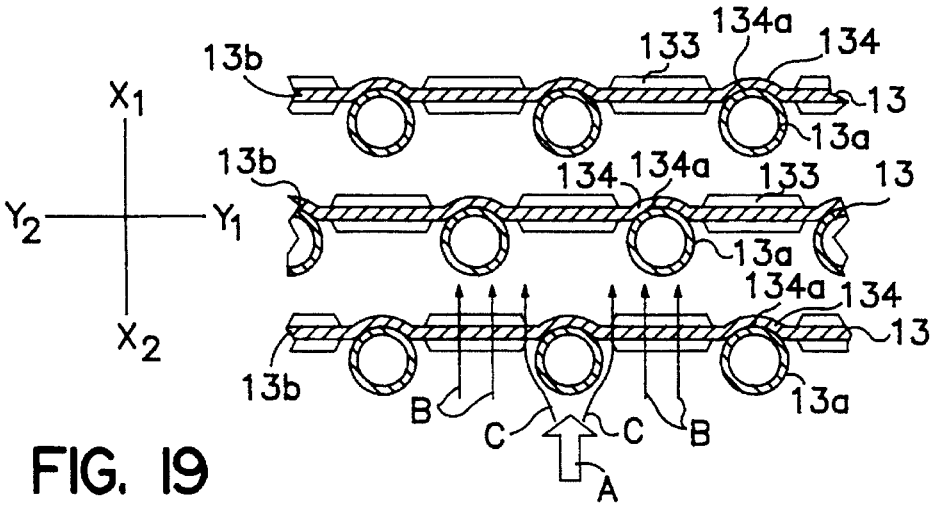
FIG. 19 is an enlarged latitudinal cross-sectional view of a portion of an evaporator in accordance with a fourth preferred embodiment.

In the fourth preferred embodiment illustrated in FIG. 19, the evaporator may be temporarily assembled by a method similar to that in the first preferred embodiment, except that circular pipes 13*a* are received in arcuate depressions 134*a*. Arcuate depressions 134*a* are formed at a central region of plane portions 134 toward the direction $X_1$ by, for example, press work. According to this preferred embodiment, circular pipes 13*a* are received in the corresponding arcuate depressions 134*a* so that circular pipes 13*a* are accurately positioned on plane portion 134. In addition, since circular pipes 13*a* and the corresponding plane portions 134 have a large contact area, circular pipes 13*a* are more firmly secured to the corresponding plane portions 134 when the temporarily assembled evaporator is brazed.

Figure 20:
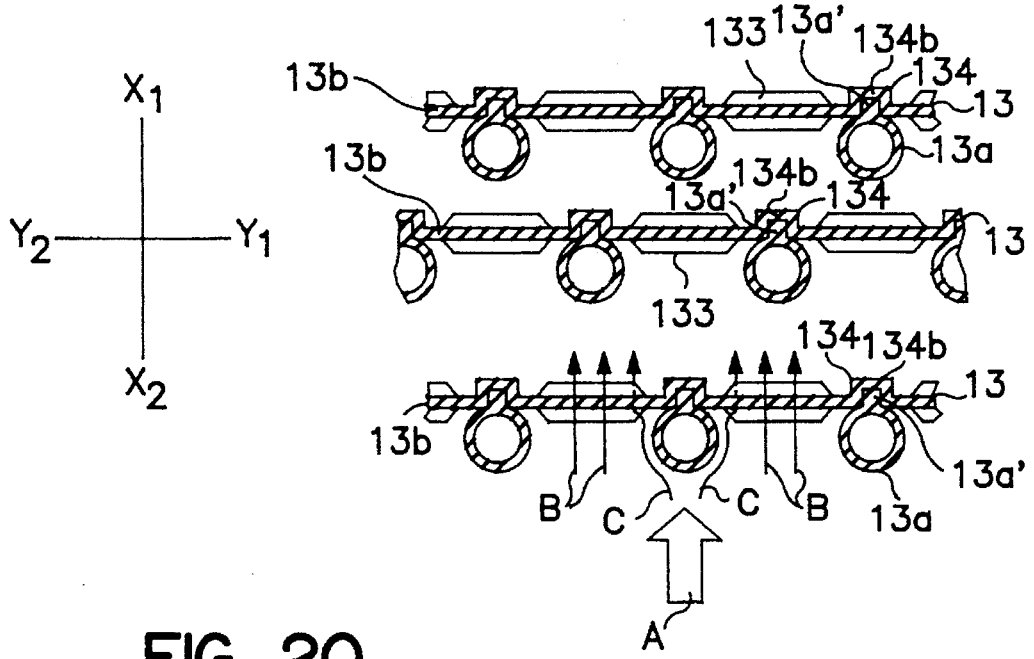
FIG. 20 is an enlarged latitudinal cross-sectional view of a portion of an evaporator in accordance with a fifth preferred embodiment.

In the fifth preferred embodiment illustrated in FIG. 20, the evaporator may be temporarily assembled by a method similar to that in the first preferred embodiment, except that a square pillar region 13*a'* formed at one peripheral portion of circular pipes 13*a* is received in corresponding rectangular-shaped grooves 134*b*. Rectangular-shaped grooves 134*b* are formed at a central region of plane portions 134 toward the $X_1$ direction, by, for example, press work. According to this preferred embodiment, square pillar region 13*a'* is received in the corresponding grooves 134*b* so that circular pipes 13*a* are accurately positioned on plane portion 134. In addition, since circular pipes 13*a* and the corresponding plane portions 134 have a large contact area, circular pipes 13*a* are more firmly secured to the corresponding plane portions 134 when the temporarily assembled evaporator is brazed.

Figure 21:
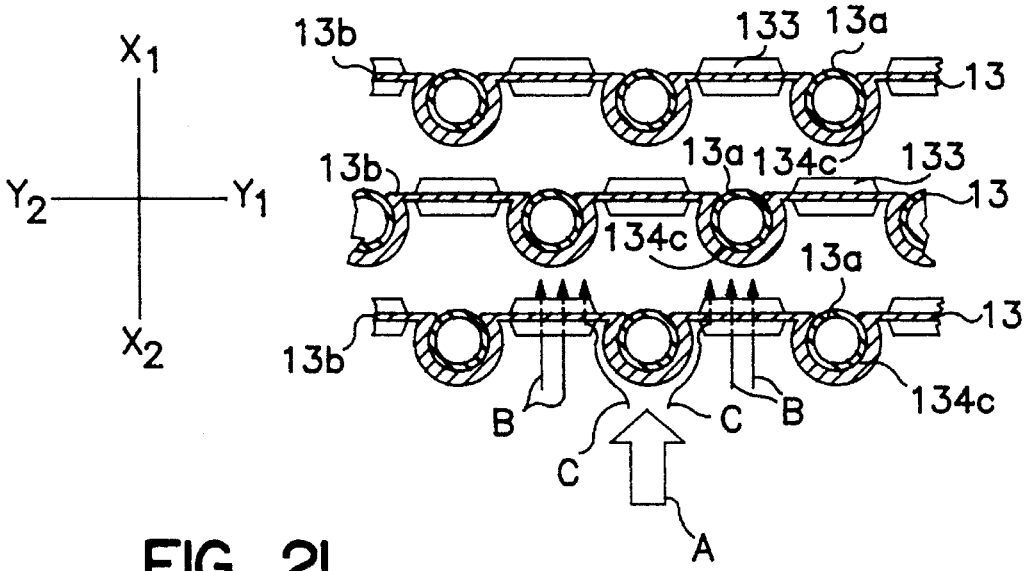
FIG. 21 is a part of an enlarged latitudinal cross-sectional view of a portion of an of an evaporator in accordance with a sixth preferred embodiment.

In the sixth preferred embodiment illustrated in FIG. 21, the evaporator may be temporarily assembled by the following method. First, a generally cylindrical groove 134*c* is formed at a central region of the corresponding plane portion 134 by, for example, rolling plane portions 134 toward the direction $X_2$. Next, circular pipes 13*a* are inserted in the corresponding generally cylindrical groove 134*c*. Then, rectangular plates 13*b* are layered one by one to create a space therebetween. After this, the evaporator is temporarily assembled in accordance with the steps similar to the corresponding steps of the first preferred embodiment. According to this embodiment, circular pipes 13*a* are received in the corresponding generally cylindrical grooves 134*c* so that the temporary assembling process is accurately performed. In addition, since circular pipes 13*a* and the corresponding plane portions 134 have a large contact area, circular pipes 13*a* are more firmly secured to the corresponding plane portions 134 when the temporarily assembled evaporator is brazed.

Although several preferred embodiments have been described in detail herein, it will be appreciated by those skilled in the art that various modifications may be made without materially departing from the novel and advantageous teachings of the invention. Accordingly, the embodiments disclosed herein are by way of example. It is to be understood that the scope of the invention is not to be limited thereby, but is to be determined by the claims which follow.

We claim:

1. A heat exchanger comprising:

a first tank;

a second tank spaced vertically from said first tank;

a plurality of heat exchange units extending between said first and second tanks, each of said heat exchange units comprising:

a plurality of pipe members having a longitudinal central axis for placing said first tank and said second tank in fluid communication, said pipe members of each of said heat exchange units being arranged such that their longitudinal central axes are aligned in a first plane;

a plate member extending along a second plane which is parallel to said first plane;

a plurality of louvers formed in said plate member and arranged in a plurality of rows which are parallel to said longitudinal central axes of said pipe members; and a plurality of plane regions defined between the adjacent rows of the openings, said pipe members connected to corresponding said plane regions of said plate member in each of said heat exchange units;

wherein said second plane is offset from said first plane toward a downstream side with respect to a flow of air passing through said heat exchanger.

2. The heat exchanger of claim 1 wherein said upper and lower tanks are rectangular parallelepiped.

3. The heat exchanger of claim 1 wherein said pipe members are made of an aluminum alloy.

4. The heat exchanger of claim 1 wherein said heat exchanger is an evaporator.

5. The heat exchanger of claim 1 wherein an axis of said louvers is parallel to a third plane which is perpendicular to the longitudinal central axes of said pipe members.

6. The heat exchanger of claim 1 wherein said plane regions of said plate member are equally spaced from one another.

7. The heat exchanger of claim 1 wherein said plane regions of said plate member are connected to the peripheral portion of the corresponding pipe member at a point which is farthest from said first plane.

8. The heat exchanger of claim 7 further comprising axial grooves formed at corresponding plane regions of said plate member, said axial grooves receiving said peripheral portion of said corresponding pipe members.

9. The heat exchanger of claim 8, said axial grooves located at a central section of each of said plane regions of said plate member.

10. The heat exchanger of claim 8 wherein said pipe members have substantially identical shapes.

11. The heat exchanger of claim 8 wherein each of said pipe members has a circular cross-section.

12. The heat exchanger of claim 11, said axial grooves have substantially arcuate cross-sections.

13. The heat exchanger of claim 11, said pipe members include a square pillar region formed at said one peripheral portion thereof.

14. The heat exchanger of claim 13 wherein said groove has a rectangular cross-section.

15. The heat exchanger of claim 11, said axial grooves comprising generally cylindrical passages formed at said corresponding plane regions.

16. The heat exchanger of claim 15 wherein each of said generally cylindrical passages is located at a central section of each of said plane regions.

17. The heat exchanger of claim 1 wherein said pipe members of adjacent heat exchange units are offset by one half of the length of the interval of said pipe members of surrounding heat exchange units.

18. The heat exchanger of claim 1 wherein said pipe members of said adjacent heat exchange units are aligned with one another.

19. The heat exchanger of claim 1, each of said heat exchange units oriented so that said first plane is perpendicular to a flow direction of air passing through said heat exchanger.

* * * * *